US005372563A

United States Patent [19]

Chien-Nan

[11] Patent Number: 5,372,563

[45] Date of Patent: Dec. 13, 1994

[54] MECHANISM FOR EXERCISING LEGS

[76] Inventor: Tsai Chien-Nan, No. 44, Lane 205, Hai Huan Street, Tainan, Taiwan, Prov. of China

[21] Appl. No.: 173,595

[22] Filed: Dec. 21, 1993

[51] Int. Cl.[5] ..... A63B 23/04

[52] U.S. Cl. ..... 482/79; 601/27; 601/31

[58] Field of Search ..... 482/79, 80; 601/27, 601/28, 29, 31

[56] References Cited

U.S. PATENT DOCUMENTS 4,949,712 8/1990 Torii ..... 601/27

5,107,822 4/1992 Ohashi ..... 482/79

*Primary Examiner*—Richard J. Apley

*Assistant Examiner*—Lynne A. Reichard

*Attorney, Agent, or Firm*—Pro-Techtor International

[57] ABSTRACT

A mechanism for exercising legs includes a housing, an eccentric wheel rotatably disposed in the housing, a follower engaged with the eccentric wheel and moved in a reciprocating way by the eccentric wheel, a board slidably supported in the housing and having a rack formed in the upper surface, a support rotatably supported on the housing and having a rack formed in the bottom for engaging with the rack of the board, the support is rotated when the eccentric wheel is rotated so as to massage and exercise the legs of the users.

4 Claims, 2 Drawing Sheets

MECHANISM FOR EXERCISING LEGS

BACKGROUND OF THE INVENTION

1. Field of the Invention

The present invention relates to a mechanism, and more particularly to a mechanism for exercising the legs of the users. 2. Description of the Prior Art Various kinds of exercising mechanisms have been provided for exercising the less of the users, however, the users have to move their own feet by themselves.

The present invention has arisen to mitigate and/or obviate the afore-described disadvantages of the conventional exercising mechanisms.

SUMMARY OF THE INVENTION

The primary objective of the present invention is to provide a mechanism for massaging and for exercising the legs of the users, the users need not to move their feet by themselves.

In accordance with one aspect of the invention, there is provided a mechanism for exercising legs comprising a housing including an upper portion having an opening formed therein, an eccentric wheel, a driving device for driving the eccentric wheel, a follower engaged with the eccentric wheel and moved in a reciprocating way when the eccentric wheel rotates, a board slidably supported in the housing and including a first rack provided on top thereof, a support rotatably supported on the housing and including a curved bottom portion extended through the opening of the housing and having a second rack provided thereon for engaging with the first rack of the board, the support being rotated when the eccentric wheel is rotated.

The housing includes a pin disposed thereon, the support is rotatably engaged on the pin, and a bearing engaged between the pin and the support for rotatably supporting the support. The board includes a pair of flanges extended downward therefrom, the follower is slidably engaged between the flanges for moving the board when the eccentric wheel is rotated. A gear is further engaged between the first rack and the second rack for rotating the support.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
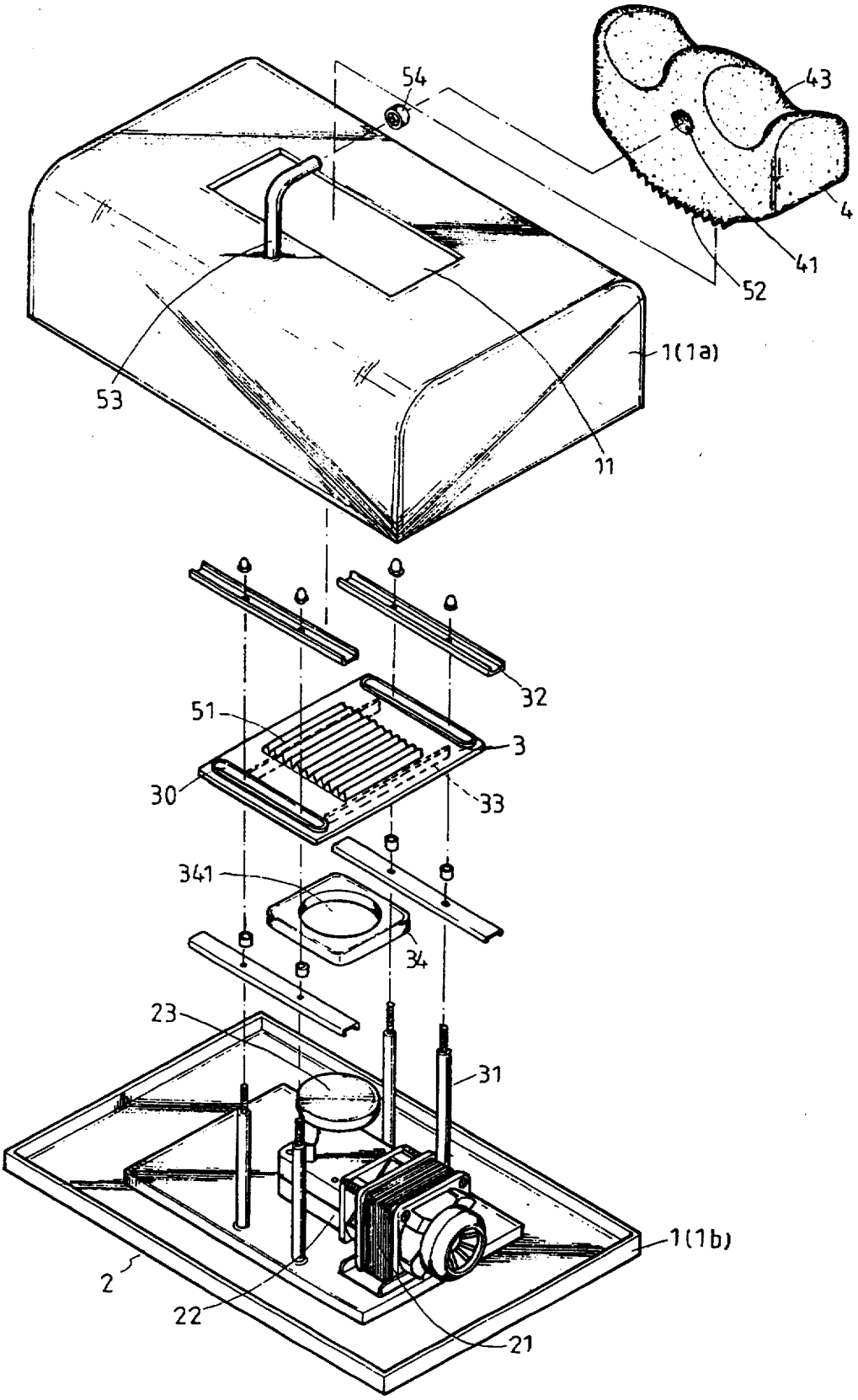
FIG. 1 is an exploded view of a mechanism for exercising the legs in accordance with the present invention.
Figure 2:
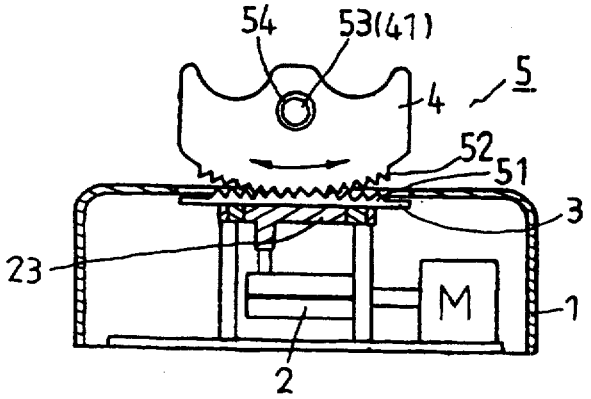
FIG. 2 is a side view of the mechanism.

Referring to the drawings, and initially to FIGS. 1 and 2, a mechanism for exercising the legs of the users in accordance with the present invention comprises a housing 1 including a base **1*b* and a cap 1*a*, a rectangular opening 11 formed in top of the cap 1*a*, a driving device 2 disposed in the housing 1 and including a reduction gearing 21 for driving a worm and gear disposed in a gear box 22, an eccentric wheel 23 coupled to the gear box 22 and driven via the reduction gearing 21 and the worm and gear disposed within the gear box 22, two pairs of plates 32 fixed on top of four rods 31, a board 3 including a pair of oblong holes 30 slidably engaged with the top portions of the rods 31 such that the board 3 is slidable in a reciprocating way by the engagement between the rods 31 and the oblong holes 30, a pair of flanges 33 extended downward from the board 3 and being parallel with each other, a follower 34 including a hole 341 formed therein for engaging with the eccentric wheel 23, and the follower 34 being engaged between the flanges 33 of the board 3 such that the follower 34 and the board 3 can be caused to move in a back and forth movement when the eccentric wheel 23 is rotated, the board 3 including a rack 51 formed in the upper surface thereof, a pin 53 fixed on top of the cap 1*a*, a support 4 including an aperture 41 for rotatably engaging with the pin 53 by a bearing 54 such that the support 4 is rotatable about the pin 53, and the support 4 including a curved bottom surface having a rack 52 formed therein and extended through the opening 11 of the cap 1*a* for engaging with the rack 51 of the board 3, and including two depressions 43** formed in the upper portion thereof for supporting the ankle portions of the users when the users lie on the ground.

As shown in FIG. 2, when the board 3 is moved in a reciprocating way by the follower 34 and the eccentric wheel 23, the support 4 can be caused to rotate about the pin 53 such that the legs of the users can be moved and rotated, whereby, the legs of the users can be exercised without moving their own feet.

Figure 3:
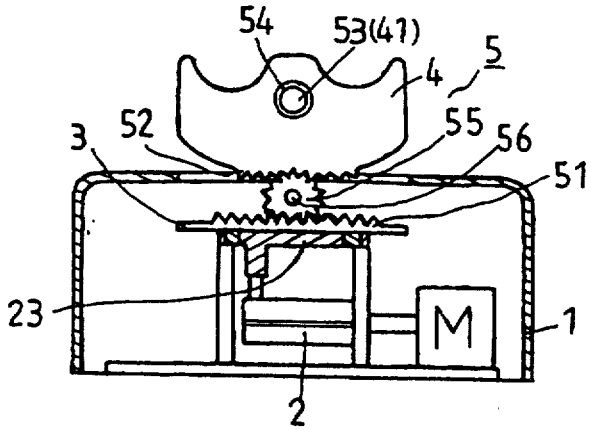
FIG. 3 is a side view illustrating another type of the mechanism.
Figure 4:
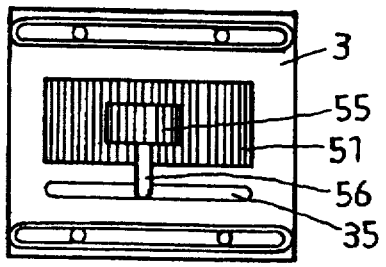
FIG. 4 is an upper view of the mechanism as shown in FIG. 3, in which part of the elements have been removed.

Referring next to FIGS. 3 and 4, a gear 55 may further be provided between the racks 51, 52 and may be rotatably supported by an L-shaped support 56 which includes one leg extended downward through an oblong hole 35 formed in the board 3 such that the board 3 may also slide in a reciprocating way without being interrupted by the support 56.

Accordingly, the mechanism in accordance with the present invention includes a mechanism for massaging and for exercising the legs of the users, the users need not to move their feet by themselves.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A mechanism for exercising legs comprising a housing including an upper portion having an opening formed therein, an eccentric wheel, a driving device for driving said eccentric wheel, a follower engaged with said eccentric wheel and moved in a reciprocating way when said eccentric wheel rotates, a board slidably supported in said housing and including a first rack provided on top thereof, a support rotatably supported on said housing and including a curved bottom portion extended through said opening of said housing and having a second rack provided thereon for engaging with said first rack of said board, said support being rotated when said eccentric wheel is rotated.

2. A mechanism according to claim 1, wherein said housing includes a pin disposed thereon, said support is rotatably engaged on said pin, and a bearing engaged between said pin and said support for rotatably supporting said support.

3. A mechanism according to claim 1, wherein said board includes a pair of flanges extended downward therefrom, said follower is slidably engaged between said flanges for moving said board when said eccentric wheel is rotated.

4. A mechanism according to claim 1 further comprising a gear engaged between said first rack and said second rack.

* * * * *